US006401300B1

(12) United States Patent
Korn et al.

(10) Patent No.: US 6,401,300 B1
(45) Date of Patent: Jun. 11, 2002

(54) HANDLE RETAINER FOR A CONTAINER

(75) Inventors: Francis E. Korn, Durham, CT (US); Allen Epstein, Clifton, NJ (US)

(73) Assignee: The Durham Manufacturing Company, Durham, CT (US)

( * ) Notice: Subject to any disclaimer, the term of this patent is extended or adjusted under 35 U.S.C. 154(b) by 0 days.

(21) Appl. No.: 09/408,207

(22) Filed: Sep. 29, 1999

(51) Int. Cl.[7] ..... A45C 5/04

(52) U.S. Cl. ..... 16/405; 16/410; 16/409; 190/115

(58) Field of Search ..... 16/405, 410, 409, 16/408, 114.1; D8/317; 190/115, 117, 118, 18 A

(56) References Cited

U.S. PATENT DOCUMENTS 3,275,336 A * 9/1966 Warner, Jr. ..... 16/405
3,642,102 A * 2/1972 Furniss et al. ..... 190/48
4,544,050 A * 10/1985 Seynhaeve ..... 190/115
5,244,113 A * 9/1993 Stymiest ..... 220/710.5
D379,170 S * 5/1997 Moore et al. ..... D12/190
D383,905 S * 9/1997 Stokes et al. ..... D3/279
6,022,638 A * 2/2000 Horton et al. ..... 429/187
6,032,334 A * 3/2000 Iima et al. ..... 16/405
6,032,771 A * 3/2000 Pedrini ..... 190/18 A
D434,634 S * 12/2000 Korn et al. ..... D8/317

* cited by examiner

*Primary Examiner*—Anthony Knight
*Assistant Examiner*—Mark Williams
(74) *Attorney, Agent, or Firm*—John H. Crozier

(57) ABSTRACT

In a preferred embodiment, a handle retainer for a container having a handle extending from a surface of the container when the handle is in a carrying position, the handle retainer including: a boss disposed on the container; and the boss and a distal end of the handle having complementarily sloped surfaces such that, when the complementarily sloped surfaces are co-engaged, the handle will be retained closely adjacent the surface in a non-carrying position.

5 Claims, 4 Drawing Sheets

HANDLE RETAINER FOR A CONTAINER

BACKGROUND OF THE INVENTION

1. Field of the Invention.

The present invention relates to containers generally and, more particularly, but not by way of limitation, to a novel handle retainer for a container.

2. Background Art.

Containers are widely used to house or carry a variety of items. Frequently, such containers have handles that facilitate the carrying of the containers. While convenient for moving and carrying the containers, the handles often protrude from the container. The latter feature can be problematic in that the handles consume space and also can become entangled with luggage handling equipment, for example. The space consuming problem can be aggravated in the case where the handles are fairly rigidly attached to the containers such that the handles are normally orthogonal, or nearly so, to the containers.

Accordingly, it is a principal object of the present invention to provide a handle retainer for a container that secures the handle closely adjacent the container when the handle is not in use.

It is a further object of the invention to provide such a handle retainer that can conveniently be placed in a retained position.

It is an additional object of the invention to provide such a handle retainer that can be economically manufactured using conventional techniques.

It is another object of the invention to provide such a handle retainer that can be molded with the elements of the container when the container is of molded construction.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a handle retainer for a container having a handle extending from a surface of said container when said handle is in a carrying position, said handle retainer comprising: a boss disposed on said container; and said boss and a distal end of said handle having complementarily sloped surfaces such that, when said complementarily sloped surfaces are co-engaged, said handle will be retained closely adjacent said surface in a non-carrying position.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
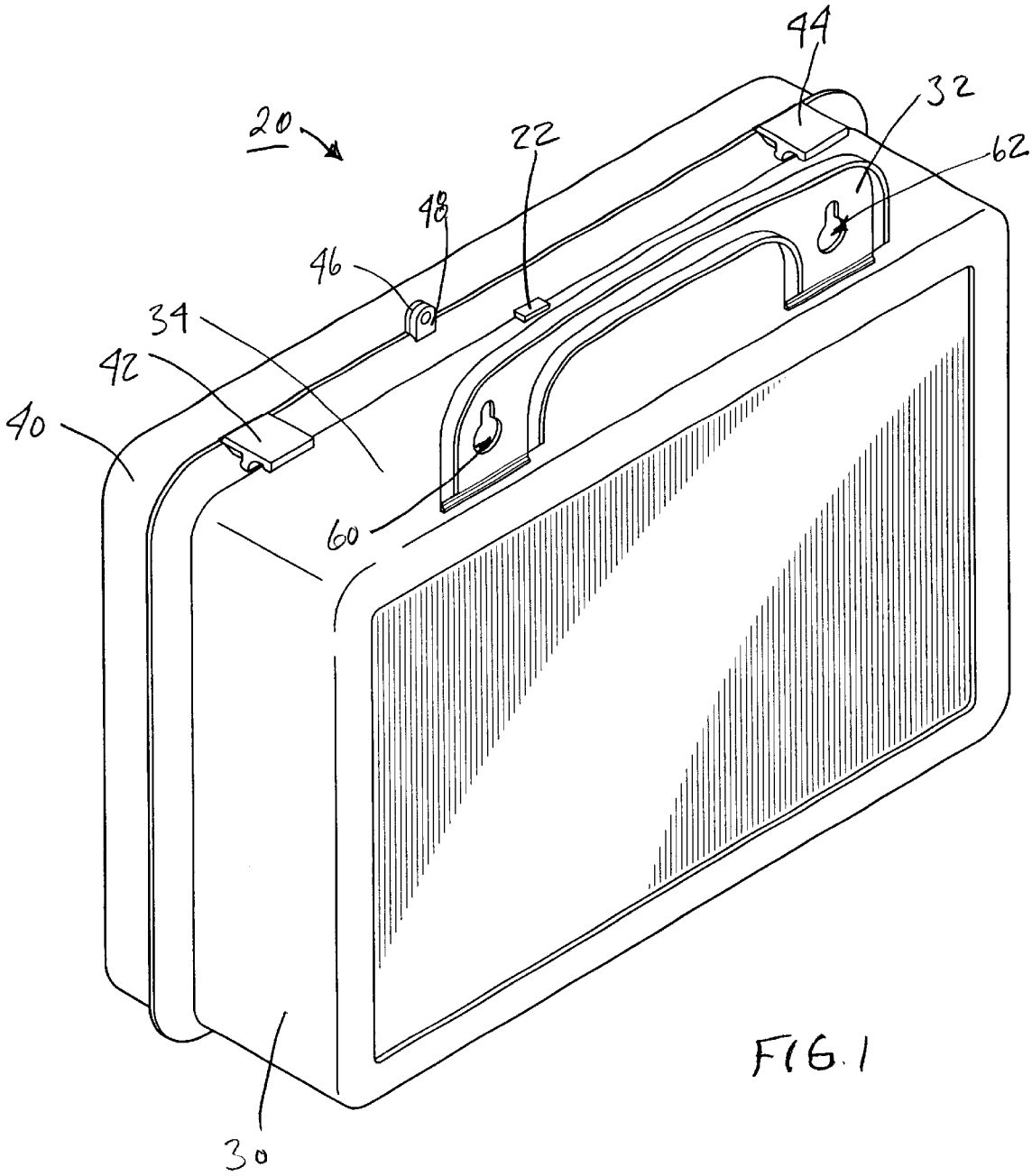
FIG. 1 is an isometric view of a container with a handle retainer according to the present invention, with the handle in carrying position.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates a container, generally indicated by the reference numeral 20, with a handle retainer 22 accordingly to the present invention.

Container 20 includes a body portion 30 having a handle 32 extending orthogonally from a surface 34 of the body portion. While not essential to the practicing of the present invention, container 20 also includes a top portion 40 that may be placed over the open end of body portion 30 to form a closed container; two clasps 42 and 44 to releasably secure top portion 40 to the body portion; and locking tabs 46 and 48 that may be used to accommodate locking means (not shown) to lock the top portion to the body portion. Also shown, but not essential to the practicing of the present invention, are two mounting holes 60 and 62 that may be used to hang container 20 on a vertical surface. The latter feature is useful, for example, when container 20 contains first aid supplies.

It will be understood from inspection of FIG. 1 that handle 32 is shown in its carrying position; that is, the handle is not in its retained position.

Figure 2:
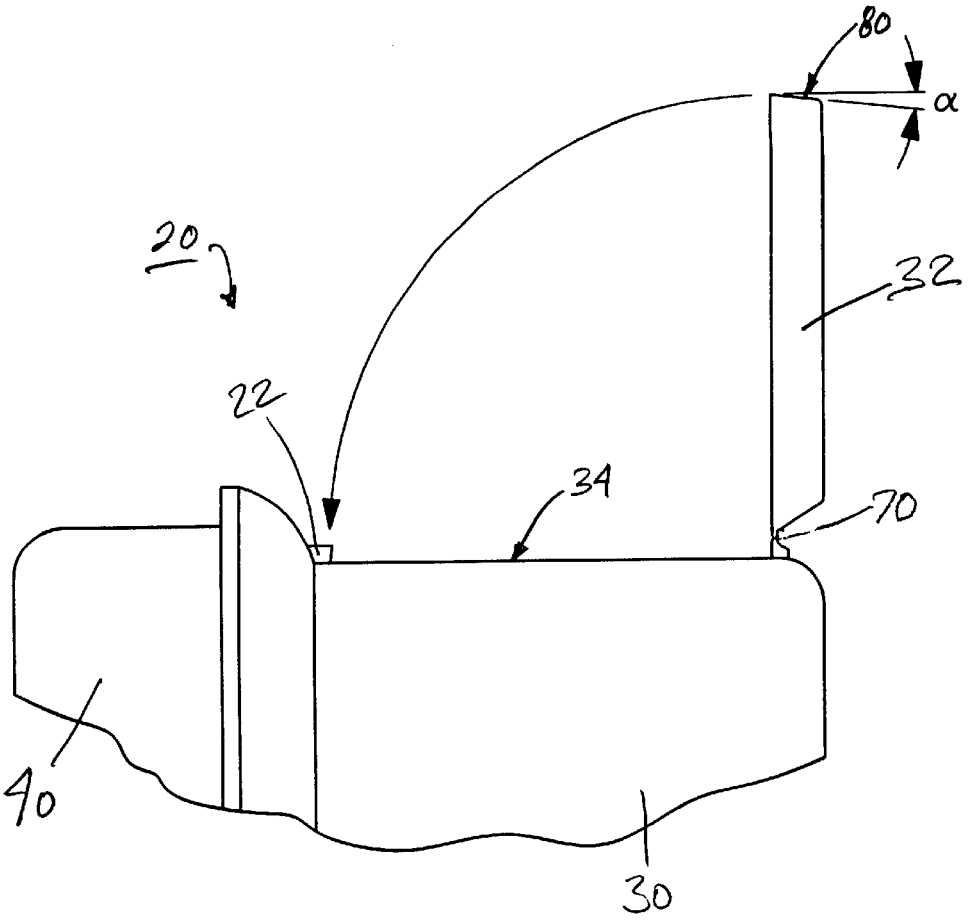
FIG. 2 is a fragmentary, side elevational view of the container with the handle in carrying position.

FIG. 2 illustrates handle 32 in its carrying position and shows a thinned section 70 disposed near the attachment point of the proximal end of the handle to surface 34, the thinned section forming a living hinge to permit the handle to be moved in the direction shown by the arrow shown on FIG. 2. FIG. 2 also illustrates that the distal end of handle 32 terminates in a sloped surface 80 indicated by the angle alpha, the sloped surface being sloped downwardly and away from retainer 22.

Figure 3:
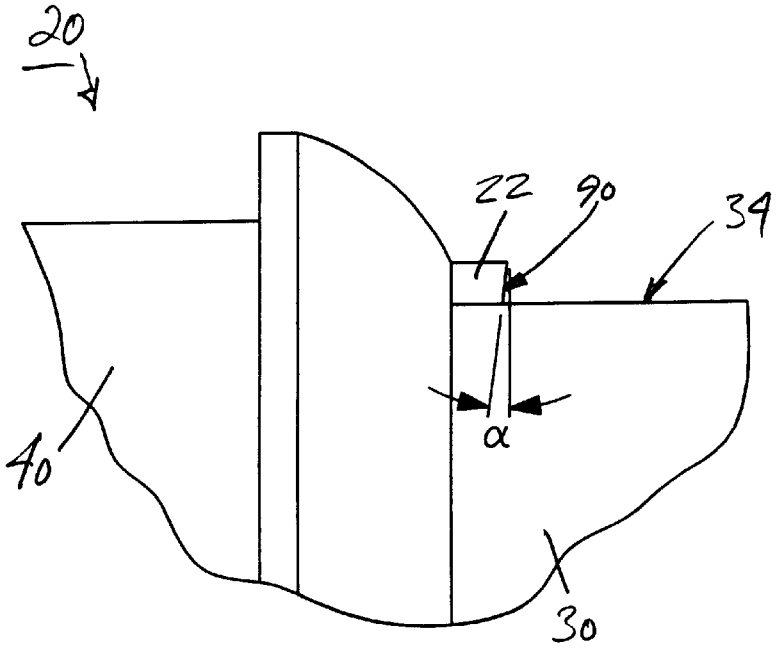
FIG. 3 is a fragmentary, side elevational view of the handle retainer.

FIG. 3 illustrates retainer 22 in more detail and shows that a surface 90 of the retainer facing handle 32 is downwardly and inwardly sloped away from the handle, also at an angle alpha, similar to the angle of surface 80 (FIG. 2).

Figure 4:
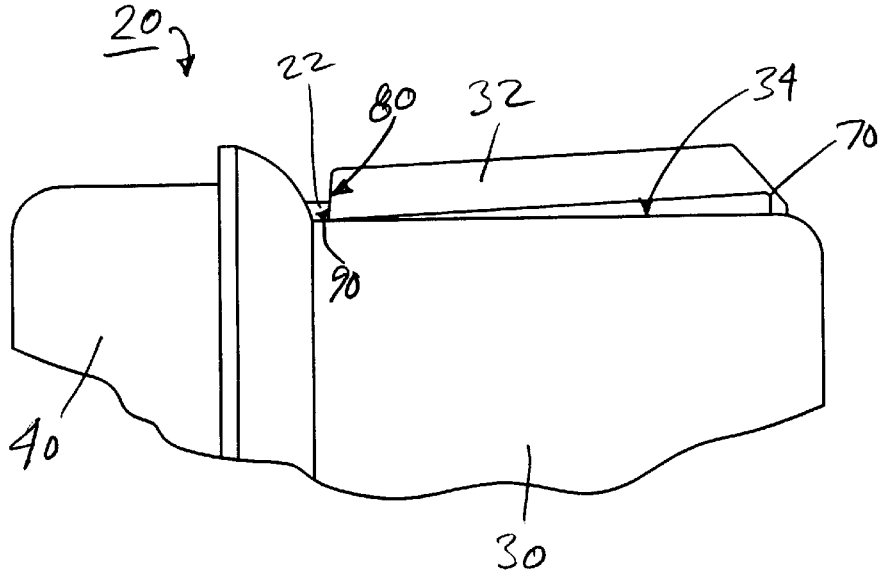
FIG. 4 is a fragmentary, side elevational view of the container with the handle in retained position.

FIG. 4 illustrates handle 32 having been bent at living hinge 70 in the direction of the arrow shown on FIG. 2, with surface 80 of the handle engaging surface 90 of retainer 22. In this position, handle 32 is closely adjacent surface 34 of body portion 30 and is secured in that position to avoid the aforementioned problems with leaving the handle in its carrying position when the handle in not in use. Handle 32 has been moved to the engaged position shown on FIG. 4 by means of the elastic deformation of the handle and surface 34.

Figure 5:
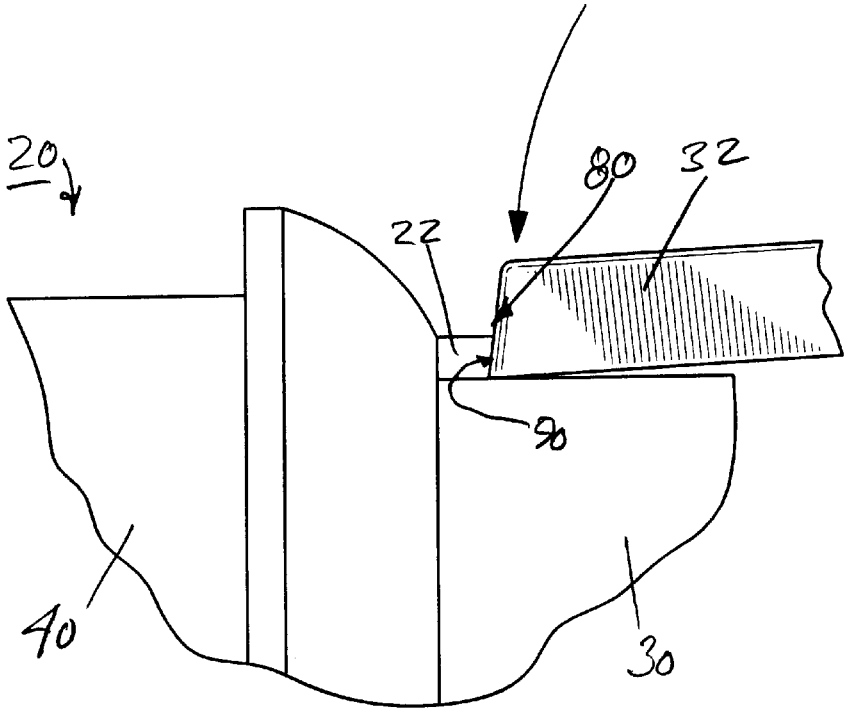
FIG. 5 is a fragmentary, side elevational view of the handle retainer with the handle in retained position.
Figure 6:
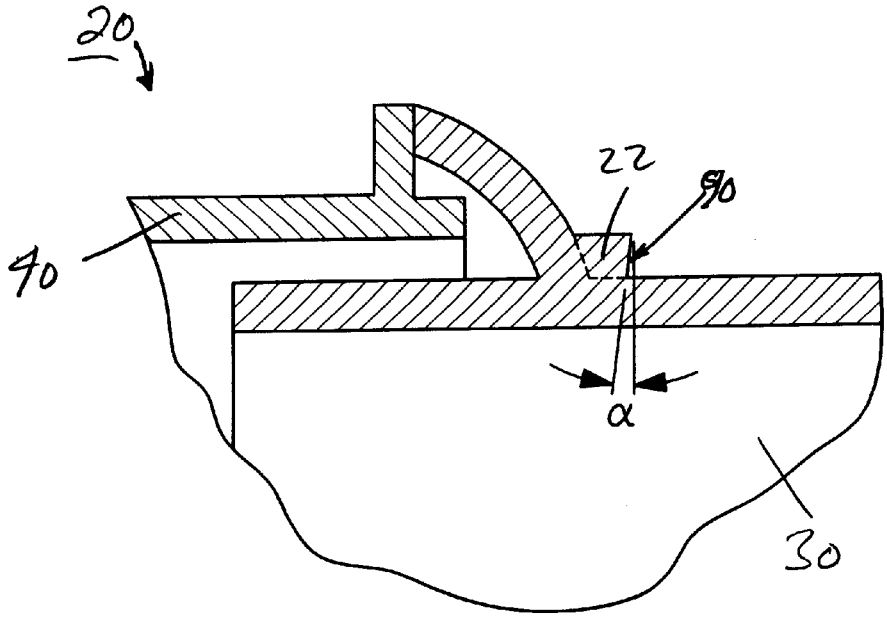
FIG. 6 is a fragmentary, side elevational view, in cross-section, of the handle retainer.
Figure 7:
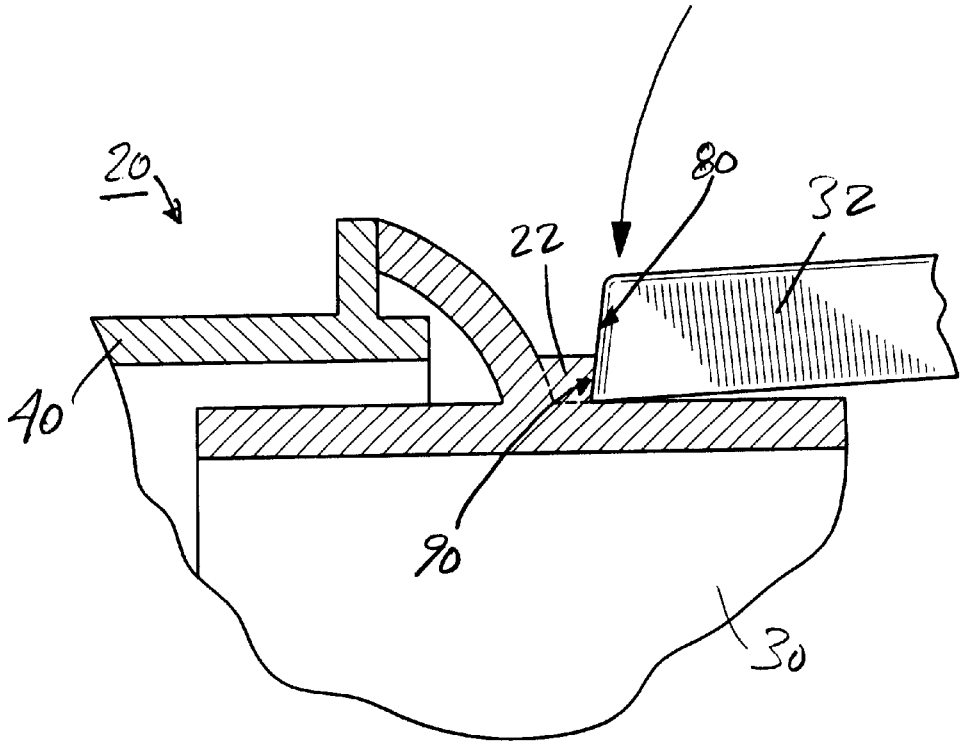
FIG. 7 is a fragmentary side elevational view, partially in cross-section, of the handle retainer with the handle in retained position.

FIG. 5 shows the engagement of surfaces 80 and 90 and FIGS. 6 and 7 are cross-sectional views equivalent, respectively, to FIGS. 3 and 5.

Retainer 22 may be conveniently and economically formed with surface 34 by conventional manufacturing methods and, when clasps 42 and 44 (FIG. 1) are attached to top portion 40 by means of living hinges and the top portion is attached to body portion 30 by means of a living hinge, all elements of container 20 may be formed from a thermoplastic material in a single, conventional molding operation.

In the embodiments of the present invention described above, it will be recognized that individual elements and/or features thereof are not necessarily limited to a particular embodiment but, where applicable, are interchangeable and can be used in any selected embodiment even though such may not be specifically shown.

Terms such as "upper", "lower", "inner", "outer", "inwardly", "outwardly", and the like, when used herein, refer to the positions of the respective elements shown on the accompanying drawing figures and the present invention is not necessarily limited to such positions.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. A handle retainer and a container having a handle extending from a surface of said container when said handle is in a carrying position, said handle retainer comprising:

(a) a boss disposed on said surface of said container;

(b) said boss and a distal end of said handle having complementarily sloped surfaces such that, when said complementarily sloped surfaces are co-engaged, said handle will be retained thereby closely adjacent said surface of said container in a non-carrying position; and (c) said handle including a living hinge formed near a proximal end of said handle.

2. A handle retainer and a container, as defined in claim 1, wherein, when said surface of said container is horizontal:

(a) said complementarily sloped surface on said distal end of said handle is sloped, from a top of said handle to a bottom of said handle, downwardly and away from said boss; and (b) said complementarily sloped surface on said boss is formed on a surface of said boss facing said handle and is sloped, from a top of said boss to a bottom of said boss, downwardly and away from said handle.

3. A handle retainer and a container, as defined in claim 1, wherein: said boss is disposed on said surface.

4. A handle retainer and a container, as defined in claim 1, wherein: all elements of said container are unitary and are formed in a single molding operation.

5. A handle retainer and a container having a handle extending from a surface of said container when said handle is in a carrying position, said handle retainer comprising:

(a) a boss disposed on said container;

(b) said boss and a distal end of said handle having complementarily sloped surfaces such that, said complementarily sloped surfaces are co-engaged, said handle will be retained closely adjacent said surface in a non-carrying position; and (c) said handle includes a living hinge formed near a proximal end of said handle.

* * * * *